United States Patent [19]

Upchurch

[11] Patent Number: 5,000,498

[45] Date of Patent: Mar. 19, 1991

[54] INTERIOR DEADBOLT KNOB FASTENING APPARATUS

[76] Inventor: Lewis E. Upchurch, 2381 Gulf to Bay Mobile Home Park, Lot #702, Clearwater, Fla. 34625

[21] Appl. No.: 562,750

[22] Filed: Aug. 3, 1990

[51] Int. Cl.[5] ..... E05B 13/00

[52] U.S. Cl. ..... 292/288; 70/416; 292/258; 292/256.67

[58] Field of Search ..... 70/416, 430, 288, 256, 70/256.67, 258

[56] References Cited

U.S. PATENT DOCUMENTS

| | | | |
|---|---|---|---|
| 177,846 | 5/1876 | Jenkins | 70/430 |
| 242,030 | 5/1881 | Osterberg | 70/430 |
| 3,585,827 | 6/1971 | Dominguez | 70/416 |
| 3,921,423 | 11/1975 | Hollins | 70/416 |
| 3,933,014 | 1/1976 | Moses | 70/416 |
| 4,064,721 | 12/1977 | Morgan | 70/416 |
| 4,185,483 | 1/1980 | Lupton et al. | 70/416 |
| 4,715,200 | 12/1987 | Katsaros | 70/416 |
| 4,827,745 | 5/1989 | Baugh | 70/416 |
| 4,869,086 | 9/1989 | Richards | 70/416 |
| 4,947,663 | 8/1990 | Yeager | 70/416 |

FOREIGN PATENT DOCUMENTS

| | | | |
|---|---|---|---|
| 2426139 | 1/1980 | France | 292/258 |
| 263570 | 1/1977 | United Kingdom | 70/416 |

*Primary Examiner*—Eric K. Nicholson
*Attorney, Agent, or Firm*—Charles E. Lykes, Jr.

[57] ABSTRACT

An apparatus for preventing the unlocking of a deadbolt lock with a key in which clamping arms are used to grip a deadbolt knob or key on the opposite side of the door and are held in place by a retaining pin which is inserted into a cavity in the door. The use of various clamping materials and types provides a degree of versatility to the apparatus.

13 Claims, 3 Drawing Sheets

INTERIOR DEADBOLT KNOB FASTENING APPARATUS

BACKGROUND OF THE INVENTION

The invention relates to deadbolt locking devices, particularly such devices which supplement the internal locking apparatus furnished with the door. Reference is made to disclosure document number 241240 filed by the inventor on Dec. 19, 1989, in which the concepts of the invention are described.

Deadbolt type locking apparatus are among the most effective and reliable forms of door locks. A typical deadbolt door lock comprises a bolt, which is essentially rectangular and without tapered surfaces, which is in sliding communication with a key turning apparatus on the exterior door side and with a knob on the interior door side. Accordingly, a person inside the door can engage and disengage the deadbolt by turning the knob. A person on the outside of the door however can only engage and disengage the deadbolt by turning it with a key.

An important feature of most deadbolt locking mechanisms is that both the internal knob and the external keyhole apparatus are operably connected in such a manner to the deadbolt that movement of the deadbolt necessarily causes both the knob and the interior keyhole apparatus to move. Accordingly, if the deadbolt is engaged with a key from the outside, this will necessarily result in the interior knob turning with the motion of the deadbolt. If either the knob or the keyhole were further locked so that they could not be moved the deadbolt mechanism could not be moved either and could not be opened from the outside.

Frequently persons who live in apartment complexes or dormitories or the like are provided with deadbolt locks by their landlords. It is not uncommon for all of the deadbolt locks within a given apartment complex or student dormitory to be adapted so as to be engaged with a common master key. Additionally, the landlord may retain a pass key for a particular lock. In such circumstances anyone coming to have possession of the master or pass key would be able to enter any of the units protected by the corresponding deadbolt lock. Additionally, there are those persons who are adept at picking locks open without the required key with "burglar tools". As this may result in the interruption of an individual's privacy or other personal dangers it is helpful to provide some means to prevent the undesired intrusion into such an apartment or school dormitory except with the permission and approval of the inhabitants.

Some prior art devices have been developed which assist in this task. For example U.S. Pat. No. 3,748,882, issued to Dusault, et al, on July 31, 1973, and U.S. Pat. No., 3,423,974, issued to Bernsley, on July 13, 1966, teach apparatus which may be positioned and installed upon a door in order to hold the interior bolt in place. Bernsley teaches a hinged holding member which is adapted with a retaining cavity to fit the interior deadbolt knob. Dusault teaches a pivotally mounted saddle, which may be secured by lugs. The saddle, which must be adapted to fit the given knob, may be pivoted into the locking position and held therein by the legs.

Cook U.S. Pat. No. 4,279,137, issued July 21, 1981, and Brill, U.S. Pat. No. 4,404,826, issued Sept. 20, 1983), are other devices which teach interior locking of deadbolt knobs. They are mentioned only to show the complexity of such devices and the requirement of each that they work with oblong or elliptical shaped interior knobs only. With respect to Suroff (U.S. Pat. No. 3,263,462, issued Aug. 2, 1966) and Cook, supra, it can be seen that some of these devices will only work with knobs at particular orientations.

While a number of such devices have been developed to accomplish this task, there are drawbacks to each of them with respect to either difficulty of installation or means and limitations of operation. Primarily, the limitations of the prior art concern both difficulty and unsightliness of installation as well as the inability of the devices to function with other than an oblong or elliptical knob wherein its length substantially exceeds its width. It would be helpful to provide such a device which is capable of simple installation, foolproof operation, and capability of operation with a variety of interior knobs.

SUMMARY OF THE INVENTION

The present invention teaches a simple and effective means of providing privacy in a dwelling protected by a deadbolt lock even from someone who has possession of a master key or pass key which would otherwise turn such a lock. The device may be generally described as a clamp which may be securely tightened about an interior deadbolt knob of any useful kind. The clamp may be further locked into a condition of immobility with respect to the interior door knob so as to prevent the engagement and motion of the deadbolt by a key.

This is accomplished by adapting the end of the clamp with a slidable pin. The door is adapted with a small hole or recessed channel which is positioned to accept the pin when depressed through the clamp and prevent any rotational motion of the clamp.

The only required installation adaptation to the door is the boring of a small hole. When not in use, the apparatus may be completely removed leaving the small hole as the only visible remnant of the apparatus. The apparatus may be used on a knob with any orientation.

Accordingly, since the clamp is securely locked about the deadbolt knob, the deadbolt itself is locked into position and may not be turned with a key from the outside. Privacy of the inhabitant is assured with respect to the deadbolt lock.

It is an object of the present invention to provide a means of preventing the engagement of a deadbolt lock mechanism from the outside of a door.

It is a further object of the present invention to provide such a deadbolt locking assistance mechanism which may be simply installed upon an existing deadbolt knob.

It is a further object of the present invention to provide such a deadbolt locking assist mechanism which may not be tampered with nor detected from the outside of the door.

It is a further object of the present invention to provide such a mechanism which may, without further adaptation, fit upon a variety of sizes and shapes of interior deadbolt knobs.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Figure 1:
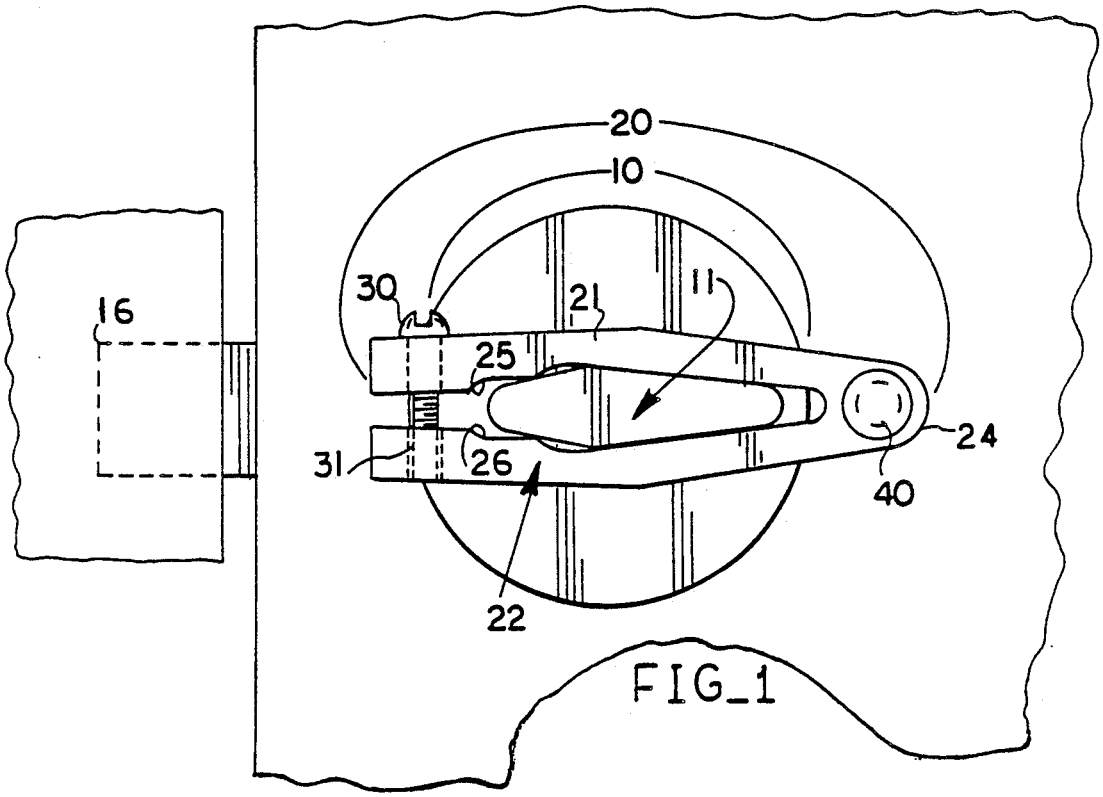
FIG. 1 is a view of the overall device as positioned upon the deadbolt lock of a door.
Figure 2:
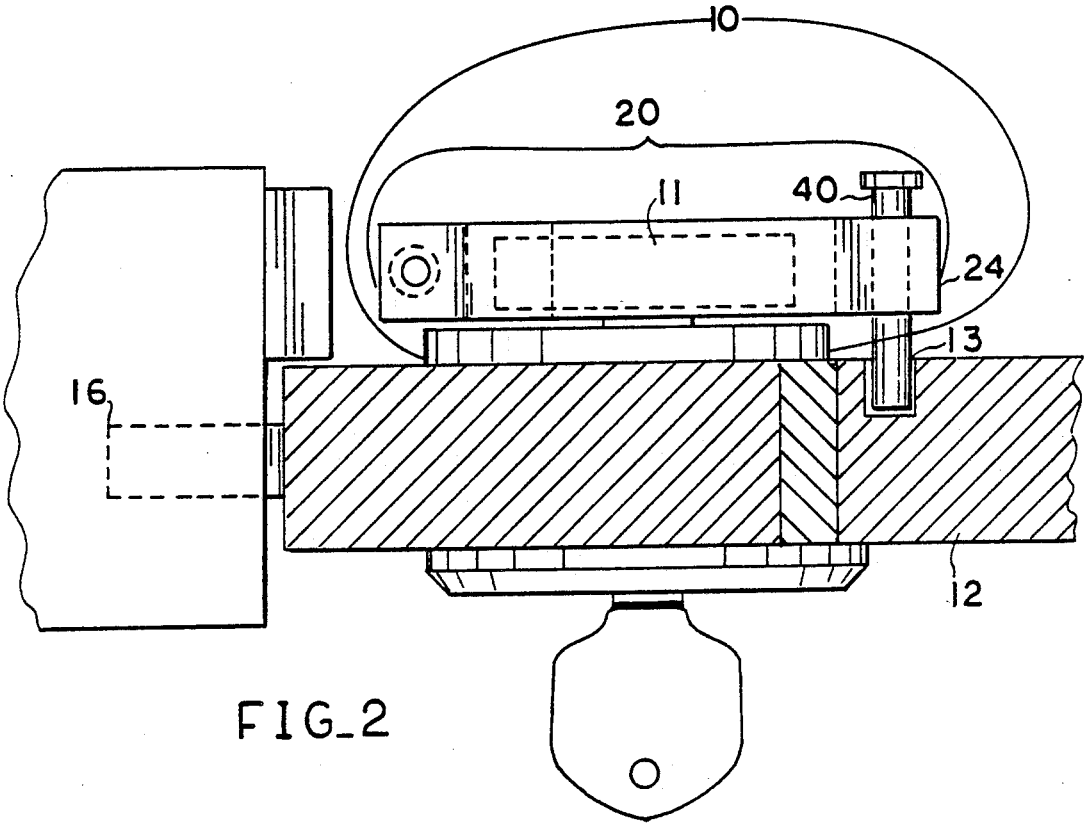
FIG. 2 is a top view of the door cross-section with the apparatus positioned thereon.
Figure 3:
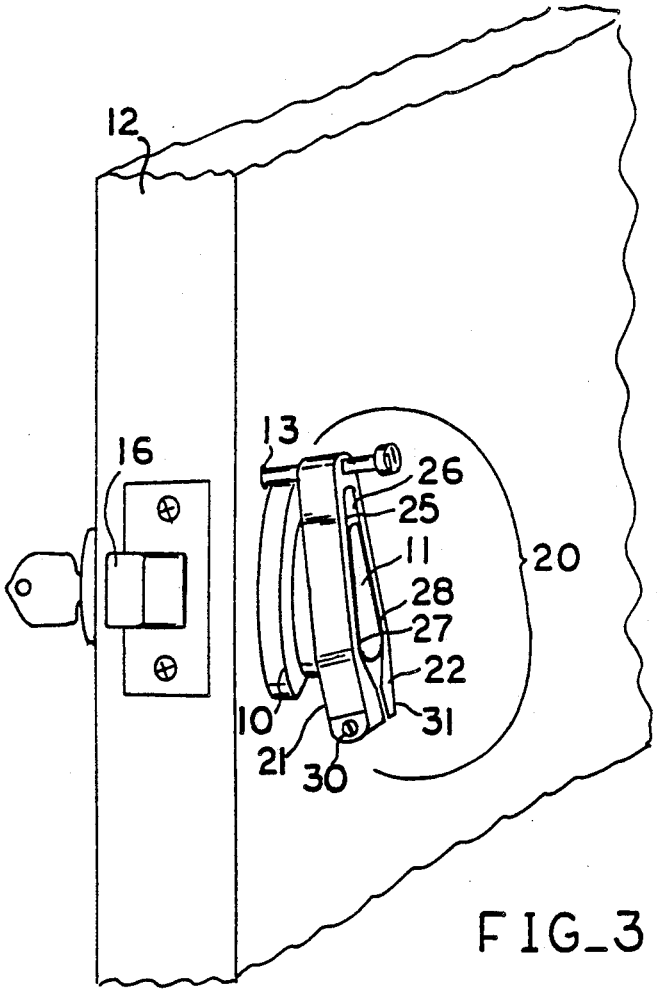
FIG. 3 is an oblique view of an open door depicting the apparatus as installed and locked.

Depicted in FIG. 1 is the inside view of a deadbolt lock (10) which is adapted with a knob (11) for alternately engaging and disengaging the lock bolt (16). Positioned upon the knob (11) is shown the overall clamping device (20) which is further adapted with at least one pivoting clamp member (21). In order to permit the clamp (20) to be securely fastened to the knob (11) the pivoting clamp member (21) is further adapted with a screw (30) which may be received by a channel (31) in the other clamp member (22). The screw (30) may be turned in order to tighten the pivoting clamp member (21) so that the knob (11) is tightly gripped on either side by the rigid clamp member (22) and the pivoting clamp member (21).

Figure 5:
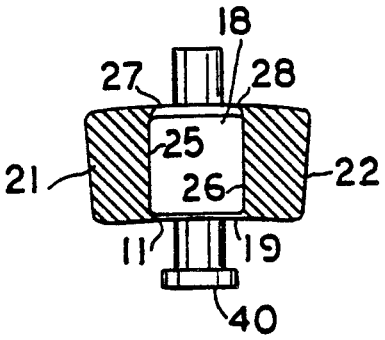
FIG. 5 depicts a cross-section of the clamping arms showing the gripping ridge.

The interior faces (25, 26) of the clamping arms (21, 22) (making reference to FIG. 5) may be further adapted with ridges (27, 28) in order to facilitate a tight, firm grip of deadbolt knobs (11) which, as most do, taper in width from a lightly wider interior side (18) than their exterior side (19).

The rigid clamp member (22) extends out and is adapted at its opposite end (24) with a sliding pin (40) which may be alternately slid back and forth through a channel (41). By adapting the door (12) with a hole (13) of adequate size to accept the pin (40) the pin (40) may be pushed through the channel (41) in the clamp member (22) into a receiving hole (13) in the door. In this manner, the clamping device (20) is securely locked upon the deadbolt knob (11) and is further locked into position (in other words may not be rotated) by the insertion of the sliding pin (40) into the door hole (13).

It is appropriate to point out that the receiving door hole (13) should not penetrate all the way through the door (12) so that the pin (40) can be pushed back out through the rigid clamp channel member (41) from the outside (14) of the door (12).

It should also be noted that the effectiveness of such a device is dependent upon several factors. To begin with the materials used for the manufacture of the clamp should be strong and rigid enough to stand up to the pressure one might apply from the key. The same may be said of both the sliding pin (40) and the material of the door (12) at the point in which the receiving pin hole (13) is made. The pin hole (13), once made should always work unless a new deadbolt mechanism is installed.

The device herein depicted would be manufactured of a material capable of adequate pivoting under tension by slight bending, such as a hard plastic. Accordingly, a separate pivot mechanism is not depicted. The clamps members (21, 22) are "pivoted" together to clamp about the knob (11) by the application of pressure from the screw (30) and requisite bending of one or both of the clamp members (21, 22).

Figure 4:
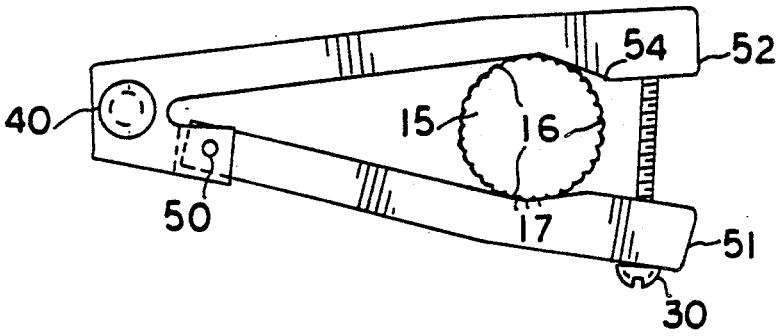
FIG. 4 depicts an embodiment of the invention adapted to work with a round deadbolt lock knob.

It is worth noting that a more rigid material or materials could be used for the clamp apparatus (20). This would require the use of a pivoting hinge (50), as depicted in FIGS. 4 and 4A, to permit the tightening of the clamps (51, 52) about the knob (53). As also depicted in FIGS. 4 and 4A, it can be seen how the device might then operate with a round or nearly round interior knob (15) which is also provided with a serrated orother irregular circumferential gripping surface (16).

By selecting a rigid clamp member (51, 52) material with an adequately pliable surface (54) (such as a wood or plastic) the clamps (51, 52) may be tightened about the knob (15) so as to fill in the spaces (17) between the serration (16) as shown in FIG. 4A. Since a round knob (15) would normally be provided with such a serrated or irregular gripping surface (16) in order to be of any practical use, this permits use of the present invention with even a round knob (15) whereas the prior art devices were all dependent upon the use of an oblong or elliptical knob, which would necessarily displace more in one axis than another upon rotation.

It should finally be considered that some deadbolt locks are installed without a knob and have keyholes on either side. Because the key grip is so small, the prior art devices, which are adapted for exclusive use with a larger and thicker knob, could allow an object as small as a key grip to rotate sufficiently to engage the deadbolt. It can also easily be seen that the present device, which permits the clamping members (21, 22) to be clamped at any desired angle, permits them to be closed sufficiently to firmly lock and hold even a narrow key grip. Accordingly, one could obtain the required privacy protection by inserting a key into the interior keyhole and clamping the device into position upon the key grip.

Accordingly, the principles of the present invention permit its use with both regularly and irregularly shaped interior knobs. It is also evident that the installation and operation of the apparatus is simplified without sacrifice of effectiveness.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. A deadbolt locking assistance apparatus for preventing the unlocking of a deadbolt lock from the outside, the apparatus comprising;

a clamp member, said clamp member having two clamping arms which are mounted from a common point of axis, at least one of which may be pivoted about such point of axis within a range and plane of rotation of said other clamping arm adequate to permit said pivoting arm to tightly grip a deadbolt knob between said clamping arms said plane of rotation being substantially parallel with the plane of the door to be locked;

said clamp member further being having a retaining pin apparatus, said pin apparatus comprising a retaining pin and a retaining pin channel, said retaining pin channel being adapted to hold said retaining pin within said clamp member and permit said retaining pin to slide along an axis perpendicular to the plane of rotation of said pivoting clamping arm, said retaining pin being further adapted to be snugly received in a hole drilled within said door in proximity to said deadbolt knob; and said clamp member further comprising a fastening means, said fastening means being positioned and adapted to fasten said clamping arms in said gripping position upon said deadbolt lock.

2. The deadbolt locking assistance apparatus described in claim 1 in which said fastening means comprises a screw which is adapted to pass through one said clamping arm near its free end and, upon tightening, draw said other clamping arm near its free end towards said first clamping arm free end.

3. The deadbolt locking assistance apparatus described in claim 1 in which at least one said clamping arm is made of a material permitting its free end to, under pressure, be drawn toward said other clamping arm free end and, in the absence of pressure, be released to a spaced equilibrium position.

4. The deadbolt locking asistance apparatus described in claim 1 in which the facing clamping arm surfaces are made of a material which, under pressure, can be squeezed upon a serrated or other irregular surface in order to acchieve a firm gripping contact.

5. The deadbolt locking assistance apparatus described in claim 2 in which at least one said clamping arm is made of a material permitting its free end to, under pressure, be drawn toward said other clamping arm free end and, in the absence of pressure, be released to a spaced equilibrium position.

6. The deadbolt locking assistance apparatus described in claim 2 in which the facing clamping arm surfaces are made of a material which, under pressure, can be squeezed upon a serrated or other irregular surface in order to achieve a firm gripping contact.

7. The deadbolt locking assistance apparatus described in claim 1 in which said clamping arms are rigid and in which at least one said rigid locking arm is pivotally mounted to said clamping member so as to pivot about a hinged axis.

8. The deadbolt locking assistance apparatus described in claim 2 in which said clamping arms are rigid and in which at least one said rigid locking arm is pivotally mounted to said clamping member so as to pivot about a hinged axis.

9. The deadbolt locking assistance apparatus described in claim 4 in which the facing clamping arm surfaces are made of a material which, under pressure, can be squeezed upon a serrated or other irregular surface in order to achieve a firm gripping contact.

10. The deadbolt locking assistance apparatus described in claim 5 in which said clamping arms are rigid and in which at least one said rigid locking arm is pivotally mounted to said clamping member so as to pivot about a hinged axis.

11. The deadbolt locking assistance apparatus described in claim 6 in which said clamping arms are rigid and in which at least one said rigid clamping arm is pivotally mounted to said clamping member so as to pivot about a hinged axis.

12. The deadbolt locking assistance apparatus described in claim 3 in which said clamping arms are adapted to grip a knob with one wider side, said adapted arm further comprising a narrow ridge running along the length of the edge of the interior face of each said clamping arm on the side corresponding to said wider knob side.

13. The deadbolt locking assistance apparatus described in claim 5 in which said clamping arms are adapted to grip a knob with one wider side, said adapted arm further comprising a narrow ridge running along the length of the edge of the interior face of each said clamping arm on the side corresponding to said wider knob side.

* * * * *